US006408802B1

(12) United States Patent
Funahashi

(10) Patent No.: US 6,408,802 B1
(45) Date of Patent: Jun. 25, 2002

(54) CAM DRIVE COOLING ARRANGEMENT

(75) Inventor: Keiya Funahashi, Hamamatsu (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/676,920

(22) Filed: Oct. 2, 2000

(30) Foreign Application Priority Data

Sep. 30, 1999 (JP) ..... 11-278307
Oct. 29, 1999 (JP) ..... 11-308101
Oct. 29, 1999 (JP) ..... 11-308107

(51) Int. Cl.[7] ..... F01P 1/06
(52) U.S. Cl. ..... 123/41.31
(58) Field of Search ..... 123/41.31, 90.31, 123/41.01, 41.29

(56) References Cited

U.S. PATENT DOCUMENTS 4,649,869 A * 3/1987 Hayashi et al. ..... 123/41.31
4,958,095 A * 9/1990 Uchida et al. ..... 123/41.31
4,958,600 A * 9/1990 Janthur ..... 123/41.31
5,655,485 A * 8/1997 Kusase et al. ..... 123/41.31
5,694,895 A * 12/1997 Tsunoda et al. ..... 123/41.31
5,836,270 A * 11/1998 Aoki et al. ..... 123/41.31
6,089,932 A * 7/2000 Nanami et al. ..... 123/90.31
6,250,981 B1 * 6/2001 Morikami ..... 123/41.31

* cited by examiner

*Primary Examiner*—Noah P. Kamen
*Assistant Examiner*—Jason Benton
(74) *Attorney, Agent, or Firm*—Knobbe, Martens, Olson & Bear, LLP

(57) ABSTRACT

A personal watercraft features a four-cycle engine. The four-cycle engine has an intake valve and an exhaust valve. The intake valve and the exhaust valve are controlled through a use of a cam drive arrangement. The cam drive arrangement is contained within a protective housing. A number of waterjackets are provided to the housing to control the temperature within the housing. In addition, the watercraft features a protective housing in which a starter motor is mounted to the cylinder block. The housing features two members that can be mounted to the cylinder block together while one member can be removed for access to the starter motor.

29 Claims, 14 Drawing Sheets

CAM DRIVE COOLING ARRANGEMENT

PRIORITY INFORMATION

This application is based on and claims priority to Japanese Patent Application Nos. 11-308101, filed Oct. 29, 1999, 11-308107, filed Oct. 29, 1999 and 11-278307, filed Sep. 30, 1999.

FIELD OF THE INVENTION

The present invention generally relates to cooling systems for internal combustion engines. More particularly, the present invention relates to cam drive cooling arrangements for use in such engines.

BACKGROUND OF THE INVENTION

Personal watercraft include internal combustion engines that are used to power marine propulsion units. The internal combustion engines are contained within substantially enclosed engine compartments. In most personal watercraft, the internal combustion engines are two-cycle engines. Two-cycle engines, however, have recently come under attack for their high hydrocarbon output. Accordingly, several techniques are being developed to reduce the emissions of such engines. Another response has been to replace the two-cycle engines with four-cycle engines. This is not without its difficulties. The four-cycle engines are more complicated to operate and control. In addition, a number of additional components are required. One of the components included in some four-cycle engines is a cam drive arrangement. The cam drive arrangement is used to operate exhaust and intake control valves, which valves are needed to control the induction of fresh air-fuel charges and the expulsion of spent exhaust gases from within the combustion chamber.

Cam shafts typically are driven through a belt drive arrangement that receives power from a pulley or sprocket mounted to the crankshaft. The power from the crankshaft is transmitted to the cam shafts through a belt or other flexible transmitter. In some applications, a gear train is used. In applications featuring a belt, a belt chamber is necessitated by the marine environment in which the watercraft are used. Salt water and other water spray encountered during operation of the watercraft, even within the substantially protected engine compartment, can cause corrosion of the belt and the other components of the cam drive arrangement.

To eliminate the problems associated with salt water and other water spray within the engine compartment, a cover arrangement has been designed to enclose the cam drive arrangement. The cam drive chamber, however, is susceptible to increased temperatures over the course of normal operation of the vehicle. The increased temperatures can damage the timing belts used in the cam drive arrangement.

SUMMARY OF THE INVENTION

Accordingly, it is desired to provide a cooling system for the cam drive arrangement. The cooling system should function to reduce or monitor or moderate the temperature within the cam drive chamber. In addition, the cooling arrangement should be integrated into a cover arrangement that is designed to protect the cam drive arrangement from the corrosive effects of the marine environment in which the watercraft is operated. By integrating the cooling system with the cover, the size and weight of the overall system can be advantageously reduced.

Accordingly, one aspect of the present invention involves an engine for a personal watercraft. The engine comprises an engine body comprising a crankcase member, a cylinder block and a cylinder head. At least one cam shaft extends outside of the engine body. A driven pulley is attached to the at least one cam shaft and is positioned outside of the engine body. A crankshaft also extends outside of the engine body. A drive pulley is connected to the crankshaft and is positioned outside of the engine body. A flexible transmitter is looped around the driven pulley and the drive pulley. A chamber is defined by at least a portion of the engine body and a first cover member. A cooling jacket extends through at least a portion of the first cover member.

Another aspect of the present invention involves an engine for a personal watercraft. The engine comprises an engine body comprising a crankcase member, a cylinder block and a cylinder head. The engine also comprises at least one cam shaft. A driven pulley is attached to the at least one cam shaft. A drive pulley is connected to the crankshaft. A flexible transmitter is looped around the driven pulley and the drive pulley. A chamber is defined by at least a portion of the engine body. A first cover member and a second cover member are provided. The engine body comprising a first sealing surface positioned on at least one of the cylinder block and the crankcase member and a second sealing surface positioned on at least one of the cylinder block and the cylinder head. A first opening is defined through the second cover member and the engine body. The crankshaft extends through the first opening. A second opening is defined through the second cover member and the engine body. The at least one cam shaft extends through the second opening. A third sealing surface is formed on the second cover member. The third sealing surface extends at least partially around the first opening and abuts at least a portion of the first sealing surface. A fourth sealing surface is formed on the second cover member. The fourth sealing surface extends at least partially around the second opening and abuts at least a portion of the second sealing surface. The first cover member abuts the second cover member and encloses at least one of the first opening and the second opening.

A further aspect of the present invention involves an engine for a personal watercraft. The engine comprises at least one drive pulley, at least one driven pulley and a flexible transmitter coupling the drive pulley and the driven pulley. The drive pulley, the driven pulley and the flexible transmitter are positioned within a belt chamber. The engine further comprises means for cooling the belt chamber.

BRIEF DESCRIPTION OF THE DRAWINGS

These and other features, aspects and advantages of the present invention now will be described with reference to the drawings of several preferred arrangements, which arrangements are intended to illustrate and not to limit the present invention, and in which drawings.

DETAILED DESCRIPTION OF THE PREFERRED EMBODIMENT OF THE INVENTION

The present invention generally relates to a cam drive cooling system for personal watercraft. The cooling system is described in conjunction with an engine powering a personal watercraft because this is an application for which the arrangement has particular utility. In particular, due to the enclosed engine compartment in which the engine is mounted and the need to reduce water infiltration into the compartment, these engines have a particular need for such a cooling system. Of course, those of ordinary skill in the relevant arts will readily appreciate that the arrangements described herein also may have utility in a wide variety of other settings.

Figure 1:
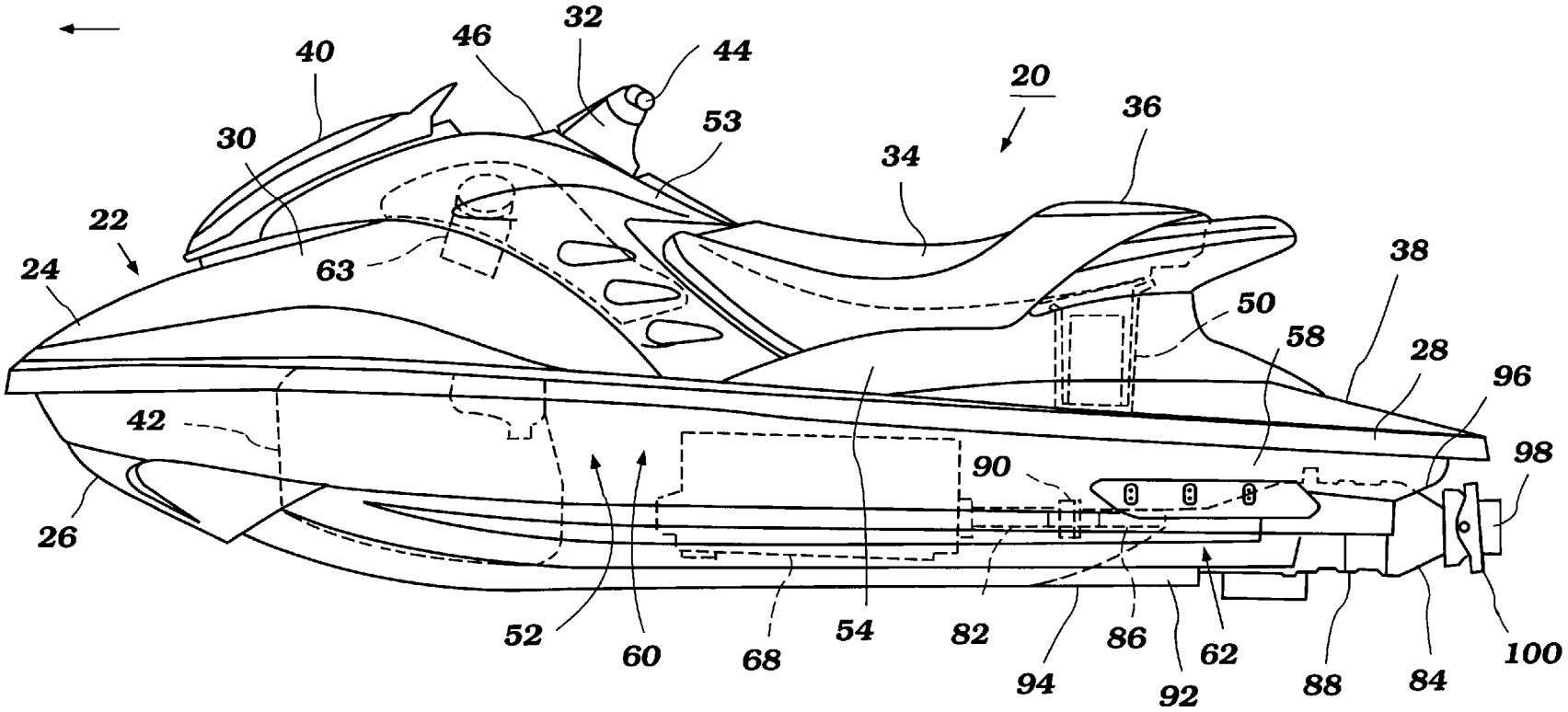
FIG. 1 is a side elevation view of a personal watercraft having a cam drive cover arrangement arranged and configured in accordance with certain features, aspects and advantages of the present invention.
Figure 2:
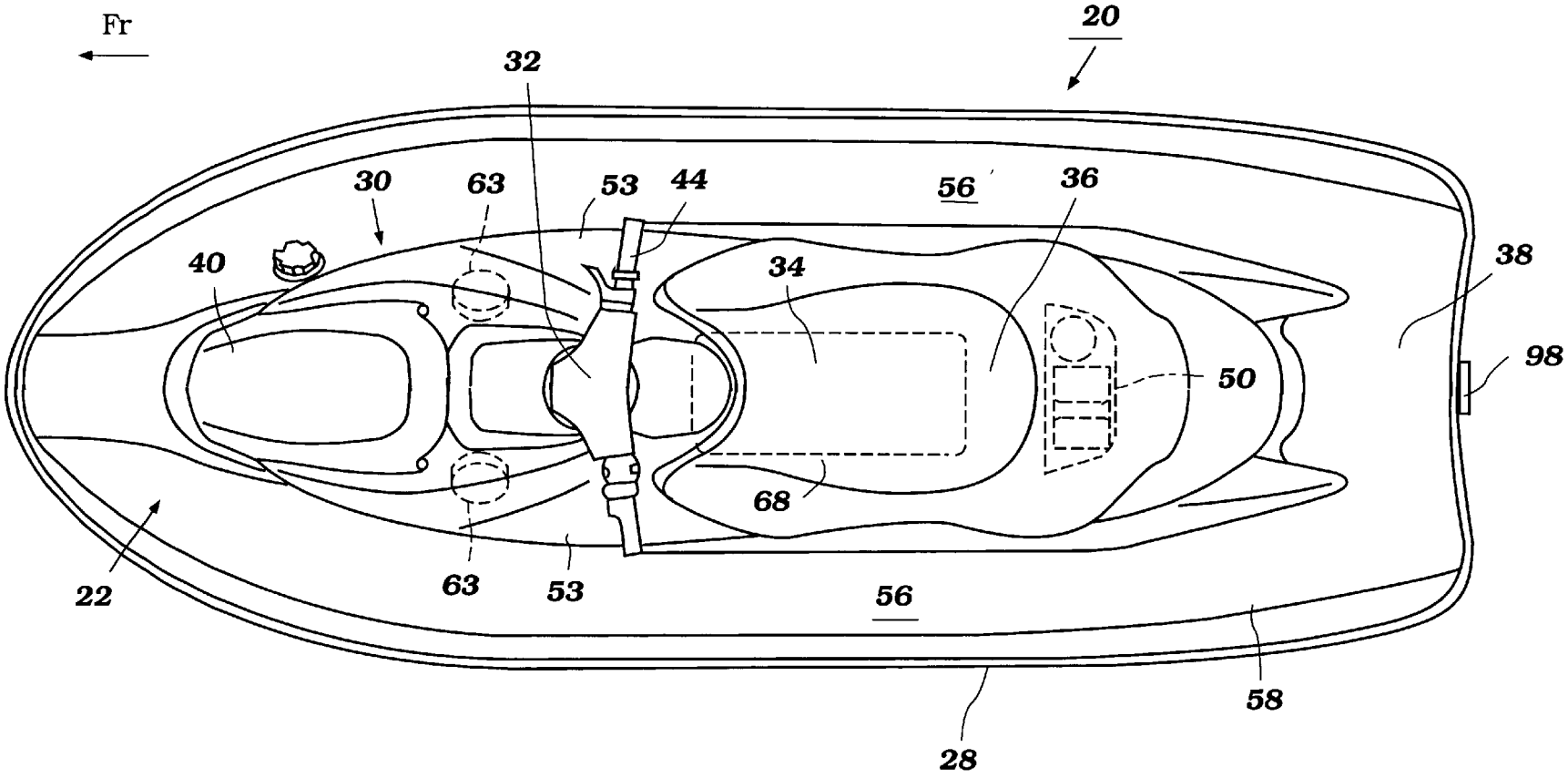
FIG. 2 is a top plan view of the watercraft of FIG. 1.

With reference now to FIGS. 1 and 2, a personal watercraft, which is indicated generally by the reference numeral 20, is illustrated therein. The watercraft 20 includes a hull 22 that is defined by a top portion or deck 24 and a lower portion 26. These portions of the hull 22 are preferably formed from a suitable material such as, for example, a molded fiberglass reinforced resin. For instance, the deck 24 can be formed using a sheet molding compound (SMC), i.e., a mixed mass of reinforced fiber and thermal setting resin, that is processed in a pressurized, closed mold. The molding process desirably is temperature controlled such that the mold is heated and cooled during the molding process. For this purpose, male and female portions of the mold can include fluid jackets through which steam and cooling water can be run to heat and cool the mold during the manufacturing process.

The lower hull portion 26 and the upper deck 24 are joined around the peripheral edge at a bond flange 28. Thus, the bond flange 28 generally defines the intersection of the lower portion 26 of the hull 22 and the deck 24.

As viewed in a direction from the bow to the stern of the watercraft 20, the upper deck portion 24 includes a bow portion 30, a control mast 32, a front seat 34, a rear seat 36 and a boarding platform 38. The bow portion 30 preferably slopes upwardly toward the control mast 32. A hatch cover 40 can be provided within the bow portion 30. The hatch cover 40 preferably is pivotably attached to the upper deck 24 and is capable of being selectively locked in a closed and substantially watertight position. The hatch cover 40 can cover a storage compartment or can be used to cover a fuel tank 42 such as that illustrated in FIG. 1.

The control mast 32 extends upward from the bow portion 30 and supports a handlebar assembly 44. The handlebar assembly 44 controls the steering of the watercraft 20 in a conventional manner. The handlebar assembly 44 also carries a variety of the controls of the watercraft, such as, for example, a throttle control, a start switch and a lanyard switch. The handlebar assembly 44 is preferably enclosed by a handlebar cover 46 and desirably is mounted for pivotal movement forward of the front seat 34.

The front 34 and rear seats 36 are desirably of the straddle-type. A straddle-type seat is well known as a longitudinally extending seat configured such that operators and passengers sit on the seat with a leg positioned to either side of the seat. Thus, an operator and at least one passenger can sit in tandem on the seats 34, 36. Moreover, these seats 34, 36 are preferably centrally located between the sides of the hull 22. The front seat 34 is preferably positioned on a bottom plate that covers an access opening that allows access into a cavity 52 defined by the hull 22. Of course, the two seats 34, 36 can be combined in some arrangements into a single seat mounted to the watercraft by a single bottom plate or the like. In addition, the seats 34, 36 can cover a compartment 50 that is positioned generally below at least a portion of the seats 34, 36. In the illustrated arrangement, the compartment 50 has a well type of configuration and is closed by the rear seat 36. A set of side panels 53 can be disposed forwardly of the front seat 34.

Figure 3:
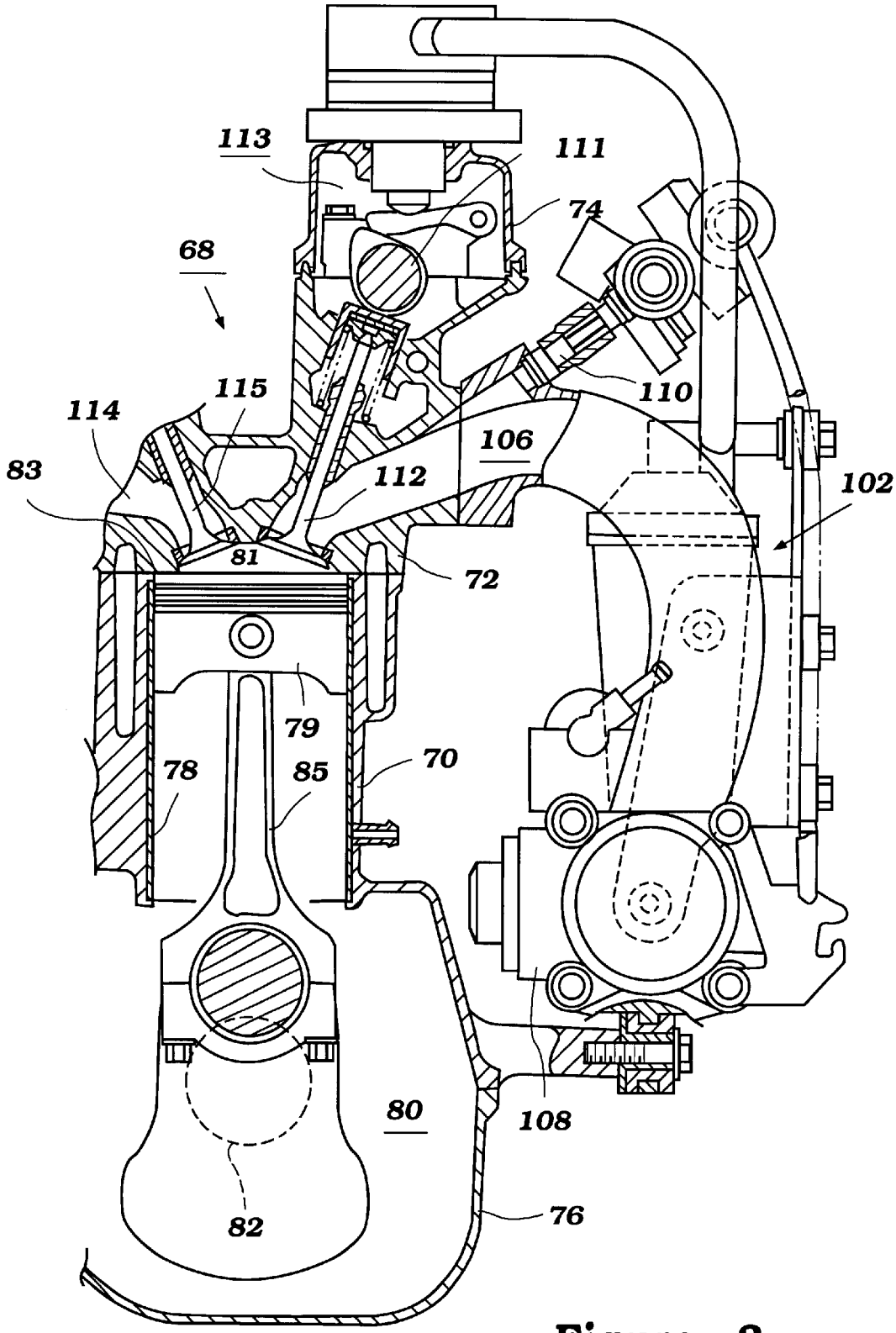
FIG. 3 is a partially sectioned front view of a four-cycle engine used in the watercraft of FIG. 1.

With continued reference to FIGS. 1 and 2, the upper deck 24 further comprises a longitudinally extending seat pedestal 54. The pedestal 54 supports the front seat 34 and the rear seat 36 in the illustrated arrangement. Foot areas 56 are formed alongside the pedestal 54 and are generally defined as the lower area located between the pedestal 54 and a pair of raised side gunwales or bulwarks 58 that extend along the outer sides of the watercraft 20. As best illustrated in FIG. 3, the foot areas 56 preferably are sized and configured to accommodate the lower legs and feet of the riders who straddle the seats 34, 36. As described above, the illustrated watercraft 20 also includes the boarding platform 38 that is connected to the illustrated foot areas 56 and that is formed at the rear of the watercraft 20 behind the pedestal 54. The boarding platform 38 allows ease of entry onto the watercraft 20.

Within the watercraft 20, the cavity 52 formed between the two hull sections 24, 26 is divided by one or more bulkheads (not shown). In the illustrated watercraft 20, a bulkhead (not shown) preferably is disposed within the hull cavity 52 to divide the cavity 52 into an engine compartment 60 and a pump chamber 62. Air ducts 63 extend into the cavity to ventilate the cavity and to cool various components of the watercraft.

An internal combustion engine 68 can be mounted within the engine compartment 60 of the illustrated watercraft 20 using resilient mounts 69 (see FIG. 4) as is well known to those of ordinary skill in the art. While the illustrated engine 68 is of a four-cycle engine, the engine 68 can have other configurations; however, because the invention primarily relates to cam cover cooling systems, the engine with which the present invention is used generally will feature at least one cam shaft or other rotary shaft driven by a crankshaft of the engine. Moreover, the engine 68 can have one, two or more than three cylinders and can be inclined, or formed with two banks of cylinders.

The general construction of a four-cycle engine is well known to those of ordinary skill in the art. With reference now to FIG. 3, the engine 68 generally comprises a cylinder block 70, a cylinder head 72, a cylinder head cover 74 and a crankcase 76. A set of cylinder bores 78 is formed within the cylinder block 70. The cylinders 78 can be sleeved in some arrangements and can be formed directly in the block 70 in other arrangements. Moreover, the cylinder bores can be formed by individual cylinder bodies (i.e., one cylinder body for each cylinder bore) that are joined to a common crankcase, for instance.

The cylinders 78 preferably are capped by the cylinder head 72 and the cylinder head cover 74. A piston 79 is reciprocally mounted within each of the cylinders 78 and a combustion chamber 81 is defined within the cylinder bore 78 by the top of the piston 79, the wall that defines the cylinder bore and a recess formed within a lower surface 83 of the cylinder head 72.

The crankcase 76 is attached to the opposite end of the cylinder block 70 from the cylinder head 72. A crankcase chamber 80 generally is defined by the crankcase 76 and the cylinder block 70. A crankshaft 82 is positioned within the crankcase 80 and is connected to the pistons 79 through a set of connecting rods 85. As the pistons 79 reciprocate within the cylinders 78, the crankshaft 82 is rotated within the crankcase chamber 80.

With reference to FIG. 1, the crankshaft 82 preferably is in driving relation with a jet propulsion unit 84 that is provided in the pump chamber 62. Specifically, the jet propulsion unit 84 preferably includes an impeller shaft 86 to which a propeller or an impeller 88 is attached. The crankshaft 82 and the impeller shaft 86 desirably are connected through a conventional shock-absorbing coupling 90. The impeller shaft 86 extends in the longitudinal direction and extends through a propulsion duct 92 that has a water inlet port 94 positioned on a lower surface of the hull 22. The lower portion 26 of the hull 22 also includes an opening 96 in the stern of the watercraft in which a jet outlet port 98 of the propulsion unit 84 is positioned. The propulsion unit 84 generates the propulsive force by applying pressure to water drawn up from the water inlet port 94 by rotating the impeller shaft 86 and by forcing the pressurized water through the jet outlet port 98 in a manner well known to those of ordinary skill in the art.

A nozzle deflector 100 or steering nozzle is connected to the jet outlet port 98 of the propulsion unit 84. The nozzle deflector 100 desirably moves in the left/right and vertical directions via a well known gimbal mechanism. The nozzle deflector 100 is connected to the handlebar assembly 44 through a steering mechanism and a trim mechanism (not shown), whereby the steering and trim angles can be changed by the operation of the handlebar assembly 44 and associated trim controls.

With reference now to FIG. 3, the engine 68 also includes an induction system 102 that provides air to each combustion chamber 81 for combustion. Air within the engine compartment 60 is supplied to the engine 68 through the air intake system 102. A replenishable air supply is provided to the engine compartment 60 through the ventilation ducts 63.

Preferably, the air intake system includes an intake box 104 (see FIG. 5) or silencer into which air from within the engine compartment 60 is drawn. More particularly, air is drawn into the silencer 104 through an intake duct 105. As will be explained, the intake duct is positioned in close proximity to a cam drive cooling cover. The air is delivered from the silencer 104 to a passage through a throttle body 108. The air then is controllably introduced into a further passage 106, in which the air is mixed with fuel in the illustrated watercraft 20.

With reference to FIG. 1, fuel is drawn from the fuel tank 42 positioned within the cavity 52 defined by the hull 22. Conventional means, such as straps (not shown) secure the fuel tank 42 in position along the lower hull portion 26. The fuel is supplied from the fuel tank 42 to a charge former 110 through any suitable fuel pumping arrangement. The charge formers 110 can be carburetors or fuel injectors depending upon the application. The arrangement illustrated in FIG. 1, however, is a fuel injector disposed for indirect injection. Of course, the present invention also can be used in direct injected engines as well.

The air-fuel charge is introduced into the combustion chamber 81 through an intake valve 112. The intake valve 112 can be of any suitable construction. In the illustrated arrangement, the intake valve 112 is spring biased into a closed position and is opened by forces exerted by a lobe positioned on a cam shaft 111. The cam shaft 111 is mounted for rotation within a cam chamber 113 defined by the head 72 and the head cover 74.

A suitable ignition system (not shown) is provided for igniting the air and fuel mixture in each combustion chamber (not shown). Preferably, this system comprises a spark plug corresponding to each cylinder 78. The spark plugs are preferably fired by a suitable ignition system as well known to those of skill in the art.

Exhaust gases generated by the engine 68 are routed from the engine 68 to a point external to the watercraft 20 by an exhaust system which includes an exhaust passage 114 leading from each combustion chamber 81 through the cylinder head 72. The exhaust passage 114 is connected to any suitable exhaust system components that will route the exhaust products from the cylinder 78 to the atmosphere or body of water in which the watercraft is operating. The flow of exhaust gases preferably is controlled by an exhaust control valve 115. The exhaust control valve also can be biased into a closed position and can be opened through a suitable cam shaft arrangement. A cam shaft driving arrangement will be discussed in further detail below.

Figure 4:
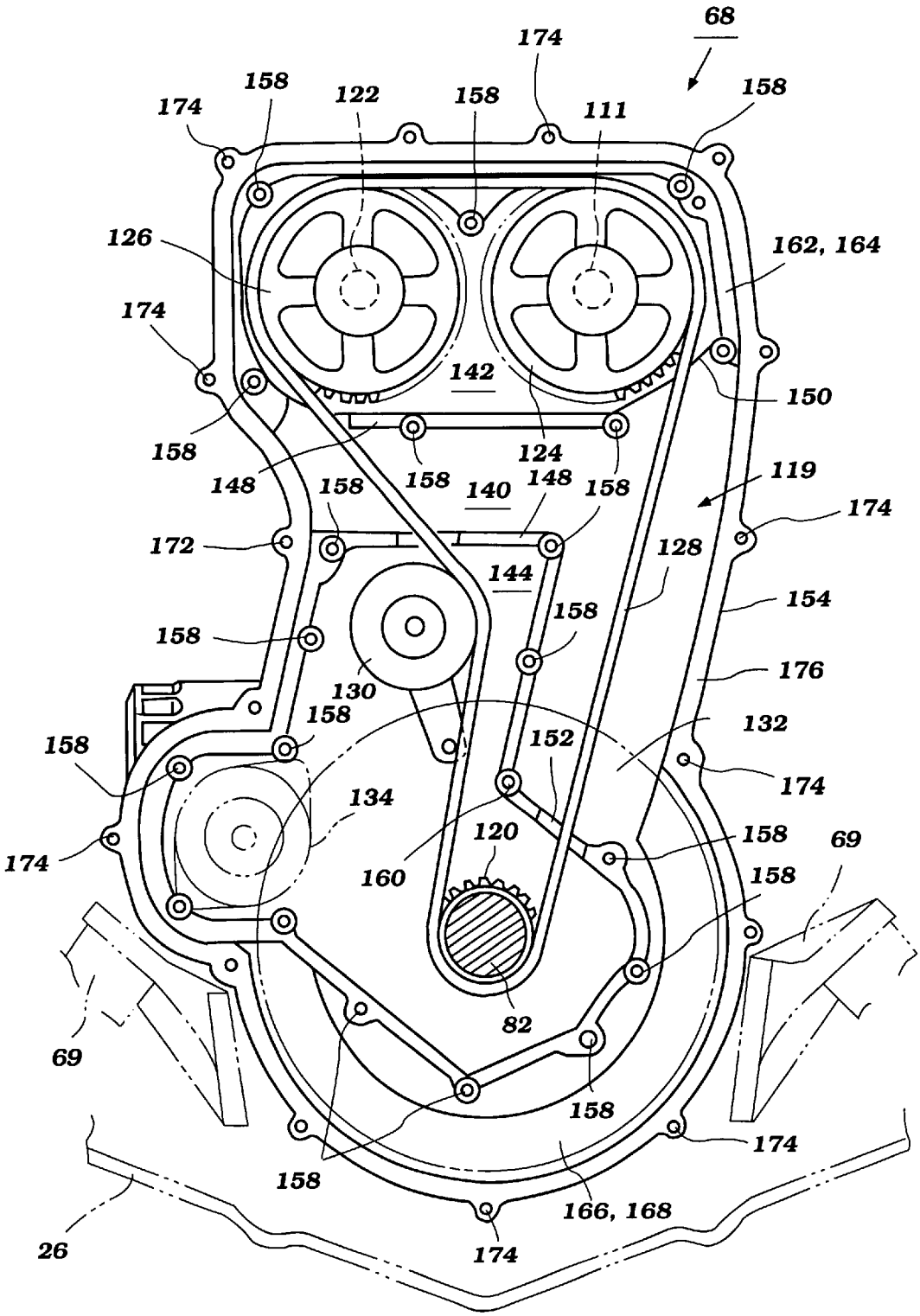
FIG. 4 is a front end view of the engine of FIG. 3 illustrating a cam drive arrangement having certain features, aspects and advantages in accordance with the present invention.

With reference now to FIG. 4, the cam drive arrangement will be described in more detail. As illustrated, the output shaft or crankshaft 82 carries a drive pulley 120. The drive pulley 120 can be mounted to the crankshaft 82 in any suitable manner. Similarly, the intake cam shaft 111 and the exhaust cam shaft 122 carry driven pulleys 124, 126 respectively. Preferably, the intake cam shaft and the exhaust cam shaft 111, 122 rotate once for every two rotations of the crankshaft 82. The driven pulleys 124, 126 and the drive pulley 120 are connected with a belt or other flexible transmitter 128. To maintain tension on the belt 128, an idler pulley 130 is positioned along a portion of the engine. The idler pulley 130 exerts a lateral force on the belt 128 to maintain the belt in driving relationship with the pulleys 120, 124, 126.

A flywheel 132 is also carried by the illustrated crankshaft 82. The flywheel 132 operates in a known manner and can be driven through the use of a starter motor 134 to initiate operation of the engine 68. The interaction between the starter motor 134 and the flywheel 132 is well known and need not be described further. However, a sealed chamber or compartment is provided for the starter motor 134 in a manner which will be described in further detail below.

Similarly, the cam drive arrangement 119 is positioned within one or more sealed chambers which will be described directly below. The sealed chambers protect the cam drive arrangement 119 from the corrosive effects of marine operation. In addition, as will be described, the sealed chambers, which are enclosed by a cover that will also be described, are advantageously moderated for temperature control. This reduces the overheating associated with most enclosed cam drive arrangements.

With continued reference to FIG. 4, the illustrated arrangement features a cam drive chamber 140 that is so divided into a first subchamber 142 and a second subchamber 144. In this arrangement, the first subchamber 142 contains the two cam shafts and their associated pulleys while the second chamber contains the idler pulley 130, the crankshaft 82 and its associated input drive pulley 120. Openings can be provided through the walls 146, 148 that define the two subchambers 142, 144 respectively. These openings 150, 152 respectively allow passage of the timing belt 128 while maintaining a substantially enclosed subcompartment. Additionally, these chambers can open into the cam chambers and the crankcase, respectively.

Figure 5:
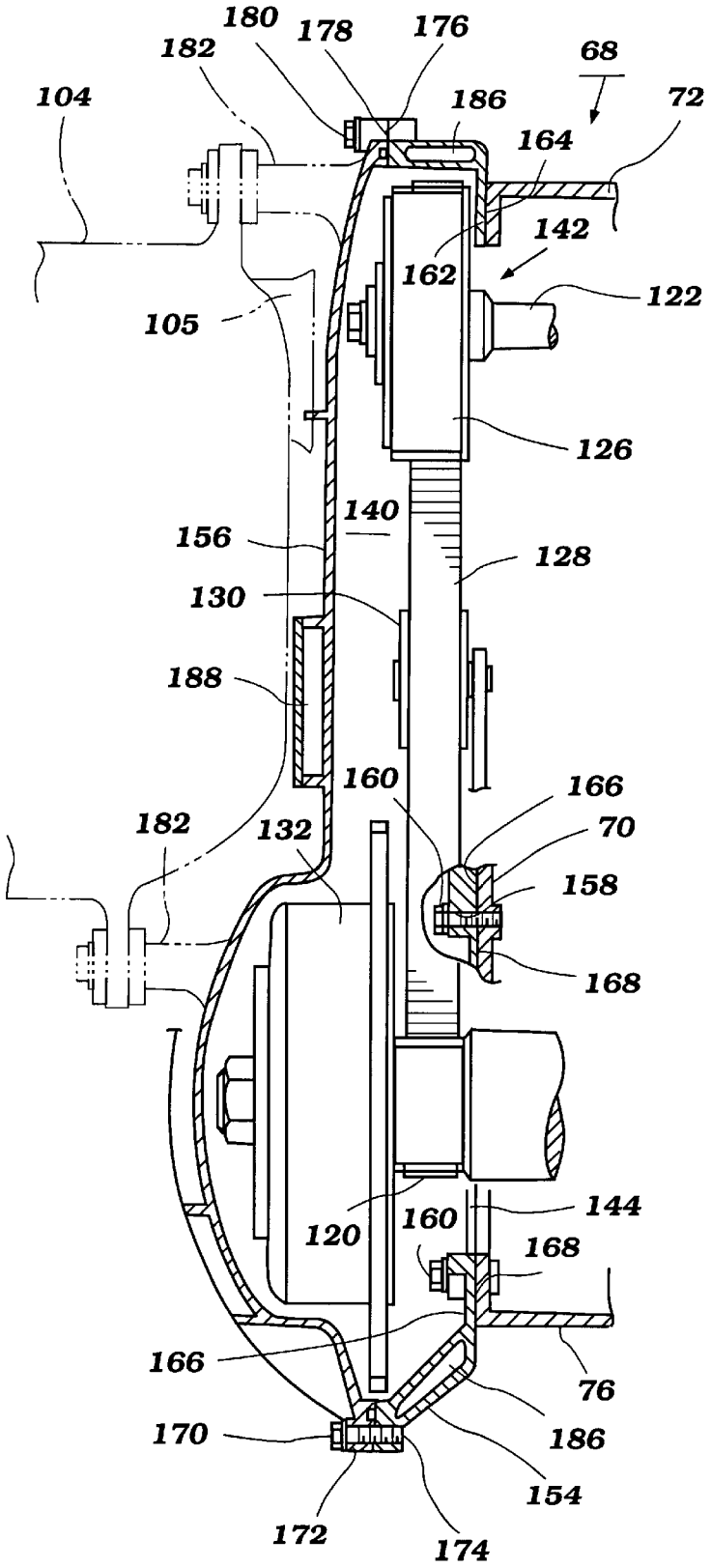
FIG. 5 is a side partially sectioned view of the cam drive arrangement of FIG. 4 and the cover arrangement of FIG. 6 with the section being taken on the line 5—5 in FIG. 6.

With reference now to FIGS. 4 and 5, the chamber 140 preferably is defined by a first cover member and a second cover member 154, 156. The first cover member 154 desirably contains a series of bolt holes 158 that accommodate threaded fasteners 160 that can be used to attach the first cover member 154 to the engine 68. In particular, in the illustrated arrangement, the threaded fasteners 160 can be used to attach the first member 154 to the crankcase 76, the cylinder block 70 and the cylinder head 72. As illustrated in FIG. 5, the openings 142, 144 extend into the associated compartments of the engine 68. In particular, the opening 142 extends into the cam shaft chamber 113 and the opening 144 at least in part extends into the crank chamber 80. Thus to form a seal, a sealing surface 162 (see FIG. 4) is positioned to abut a flange 164 formed on the cylinder head 72. Similarly, a second sealing surface 166 can be formed that will abut against a second flange 168 formed on the crankcase 76. These abutting flanges provide a seal around an upper portion and a lower portion of the engine as will be understood from FIG. 4.

With continued reference to FIG. 5, the second cover member 156 preferably is attached to the first cover member 154 through the use of threaded fasteners 170. The threaded fasteners 170 extend through a set of holes 172 formed in the second cover member and through a set of holes 174 formed in the first cover member. Preferably, at least one set of these holes is threaded. In the illustrated arrangement, the holes 174 formed in the second member are threaded and receive the threaded fastener 170. Of course, clamps and other types of suitable fastening arrangements can be used. In addition, a bolt and nut combination can also be used. In some configurations, a threaded insert can be formed with the first cover member 154 that receives the bolt or threaded number 170 that passes through the second cover member 156. Of course, the first and second cover members 154, 156 can be interchanged in the mounting configuration. Preferably, a sealing surface 176 is formed on the first cover member 154 and a second sealing surface 168 is formed on the second cover member 156. The sealing members 176, 178 abut each other face-to-face and can accommodate a seal 180 that acts a gasket to better seal the connection between the two cover members 154, 156.

With reference to FIG. 5, the air intake box 104 preferably is mounted to a set of flanges 182 that extend off of the cover members 154, 156. These flanges can be formed integrally with the second cover member 156 in some applications. Of course other suitable constructions also can be used. Advantageously, the mounting of the air intake box 104 to the cover 156 positions the air intake duct 105 proximate the cover for reasons that will be discussed below.

With continued reference to FIG. 5, a set of cooling passages 186 are positioned within the first cover member 154. The cooling passages 186, as will be discussed, are connected to a coolant source that allows circulation through the cooling passage of a cooling fluid, such as water that is drawn from the body of water in which the watercraft is being operated. Additionally, a second cooling passage 188 can be formed in the second cover member 156. As will be recognized, the first cooling jacket 186 is provided around the circumference of the illustrated chamber 140. Additionally, the second cooling jacket 188 extends across a central region of the chamber 140 proximate the location in which the idler pulley 130 is mounted. Of course other suitable constructions also can be used.

With reference now to FIGS. 6–9, additional cooling arrangements are illustrated therein. In these configurations, like elements will be referred to by like reference numerals. However, the arrangement of the cooling jackets will differ from construction to construction. In particular, the positioning of the cooling element will vary from one construction to the next. It should be noted that some or all of these arrangements can be combined.

Figure 6:
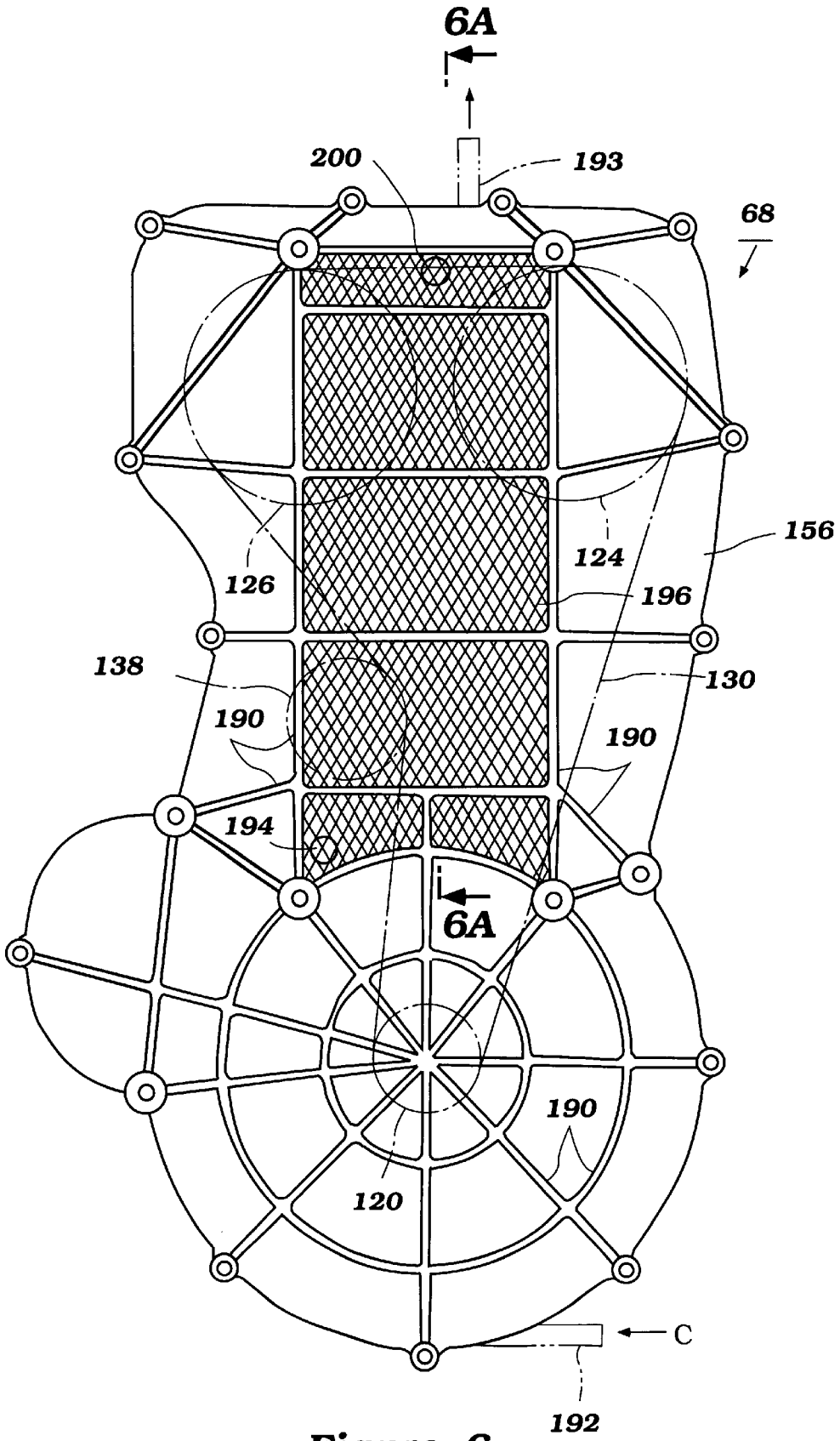
FIG. 6 is a front elevation view of a cam drive cover with a first cooling jacket illustrated in crossed hatched lines.
Figure 6A:
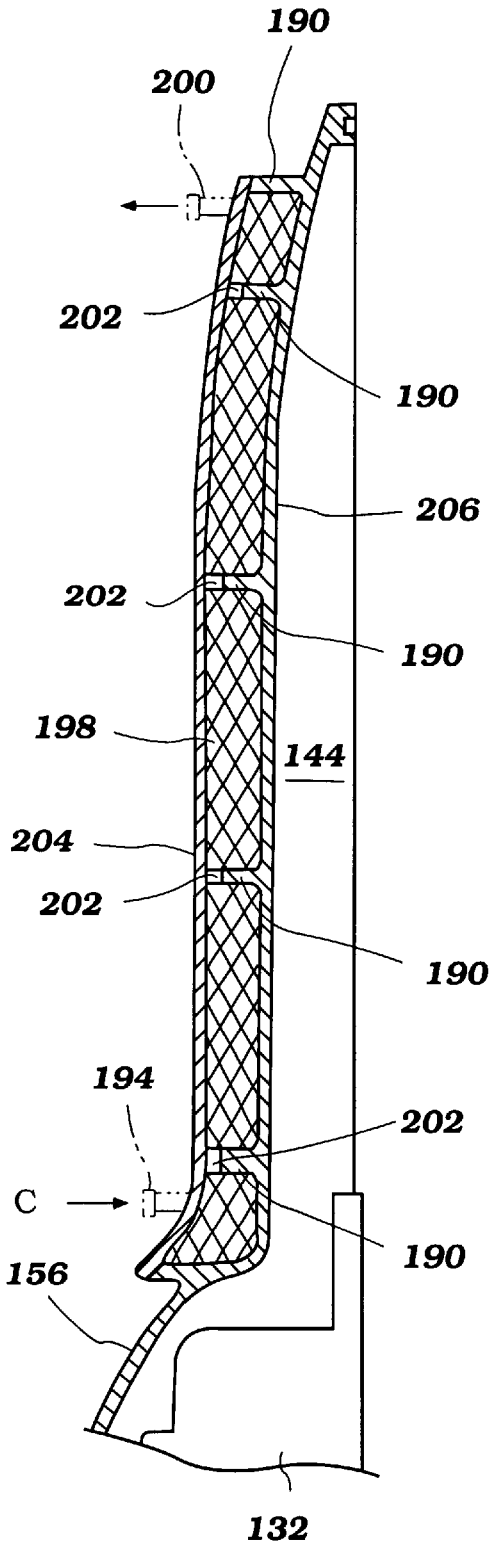

With reference now to FIG. 6, the illustrated cover member 156 advantageously comprises a number of stiffening ribs 190. The ribs 190 perform a strengthening function and increase the rigidity and strength of the cover member 156. The ribs 190 can be arranged and configured in any suitable arrangement such that the cover member 156 is adequately supported.

The cover member 156 also advantageously includes a water inlet nozzle 192. The inlet nozzle 192 can be formed on either the first cover member 154 or the second cover member 156 or a combination of the two. The inlet 192 provides coolant, indicated by the reference letter C, into the cooling jackets of the cover arrangement of FIG. 6. In the illustrated arrangement, the coolant C circulates through a water jacket such as that illustrated in FIG. 5. The circumferential coolant jacket 154 preferably includes the water inlet 192 as well as the water outlet 193. The water outlet 193 can be used to supply the coolant to another component or can be used as an outlet of the coolant into a holding reservoir or the body of water in which the watercraft is operating. In some arrangements, coolant from the circumferential coolant jacket 154 is supplied to an inlet nozzle 194 provided on the cooling jacket 196. With reference now to FIG. 6, the cooling jacket 196 comprises the coolant passage 198 that extends between the inlet 194 and an outlet 200. As illustrated, a number of supporting walls or the ribs 190 extend through the cooling water passage 198. The ribs 190, however, are at least partially truncated to provide passages 202 that connect the spaces between the ribs 190. In one construction, this is arranged through the use of a lid 204 that is used to enclose the water passage 198 when the lid 204 is connected to a base number 206.

Figure 7:
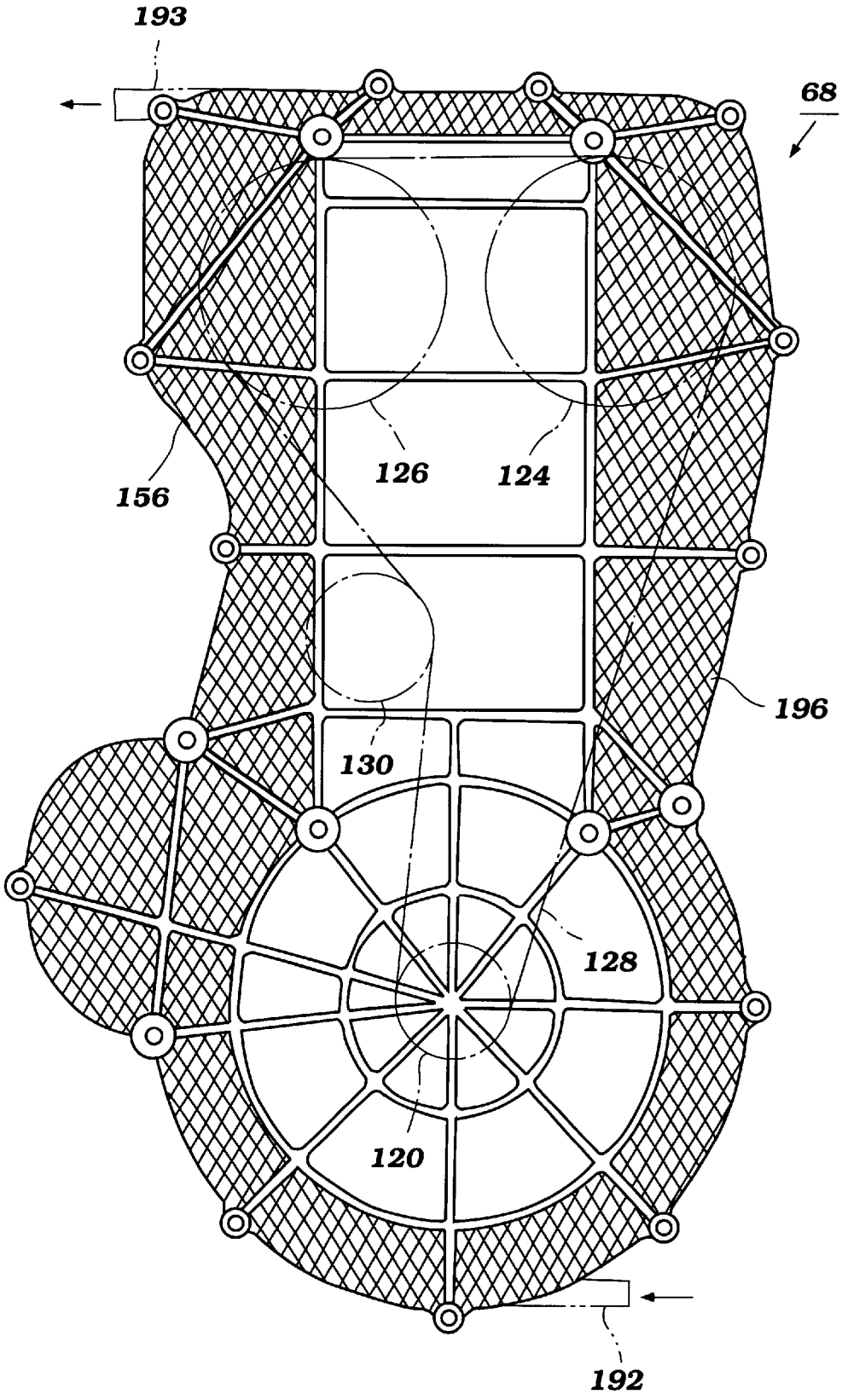
FIG. 7 is a front elevation view of a cam drive cover arrangement with a second cooling jacket illustrated in cross hatch lines.
Figure 8:
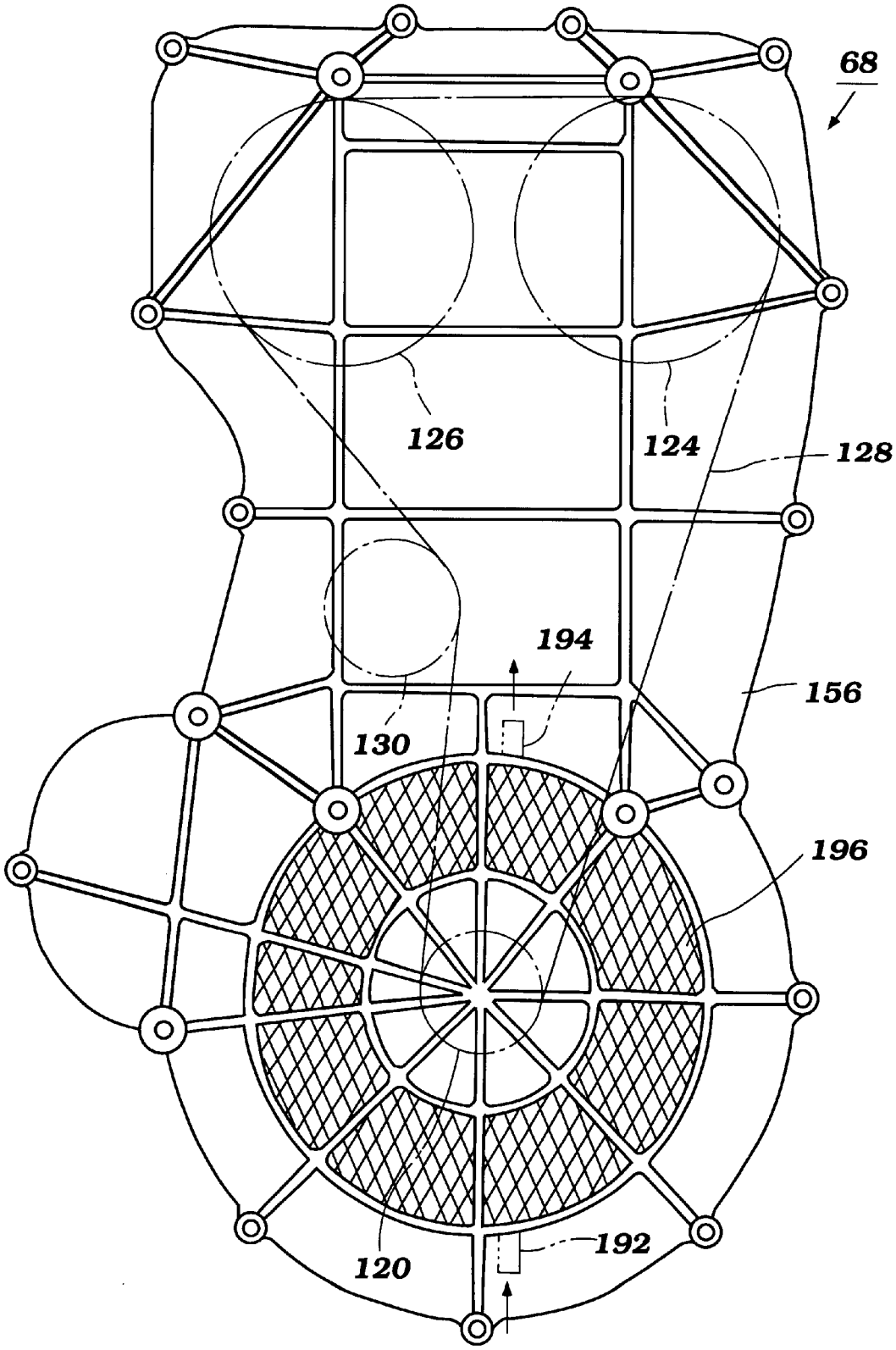
FIG. 8 is a front elevation view of a cam drive cover arrangement having a third cooling jacket illustrated in cross hatch line.
Figure 9:
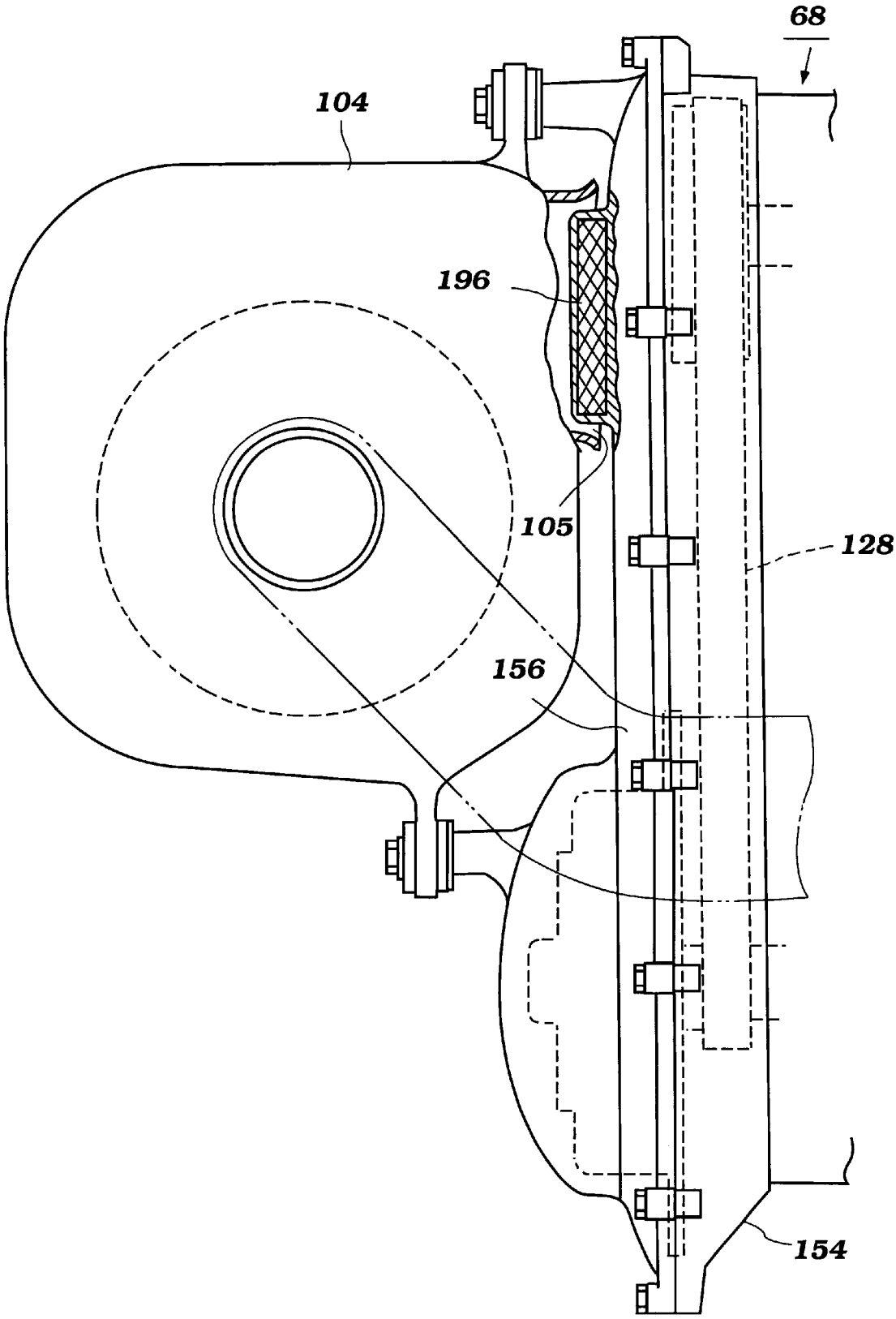
FIG. 9 is a side elevation view illustrating a juxtaposition of an intake duct and a portion of a cooling jacket of a cam cover arrangement.

With reference now to FIGS. 7, 8 and 9, similar cooling jacket constructions are illustrated therein. Of course, in each of these arrangements, different portions of the cam drive arrangement 119 are covered with the cooling jacket. It should be recognized by those of ordinary skill in the art, that any number of these configurations can be combined and/or subdivided into varying regions. In addition, some arrangements, such as that illustrated in FIG. 9, advantageously enhance the heat transfer between the cooling fluid contained within the coolant jacket 196 and the air being inducted into the induction system through the air box 104.

With reference now to FIGS. 10–13, a starter motor compartment is illustrated therein. The starter motor compartment advantageously protects the starter motor and its associated components from the corrosive effects of water. In addition, as a starter motor in the illustrated arrangement is an electrical motor, the water can have an adverse effect on the operation of the electric motor should water infiltrate and contact the electrical motor.

Figure 10:
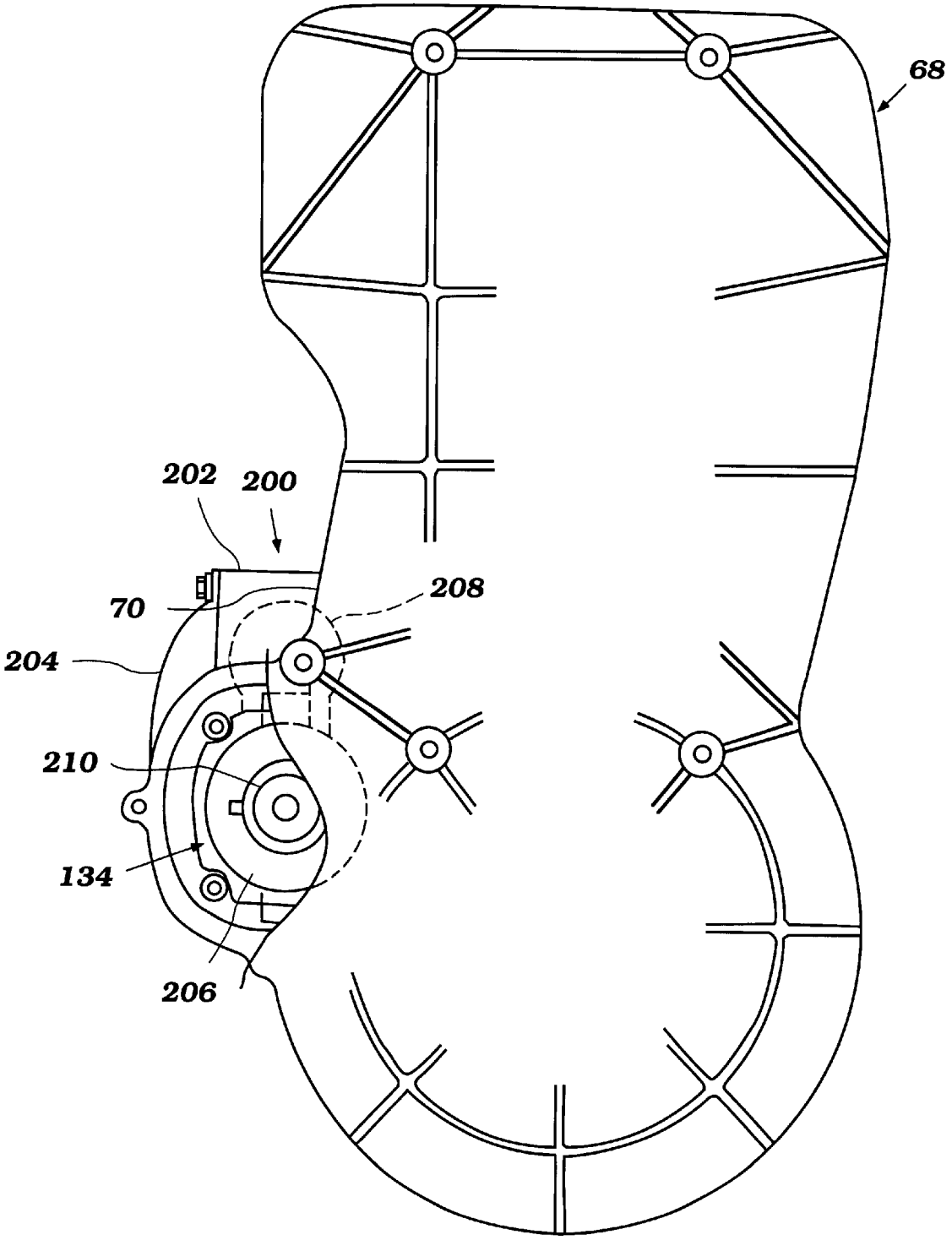
FIG. 10 is a front elevation view of a cam cover arrangement and a starter motor compartment that is illustrated in partial section.

With reference now to FIG. 10, the starter motor is positioned within a housing 200. The housing 200 generally includes a first cover member 202 and second member 204. The housing 200 encloses the starter motor 134 which includes the main body of the starter motor 206 as well as a magnetic switch 208 which is used to actuate the starter motor 134. As is known to those of ordinary skill in the art, the starter motor generally comprises a starter gear 210 which is arranged to mesh with a gear on the flywheel 132. When the magnetic switch 208 turns a starter motor on, rotation of the gear 210 causes rotation of the flywheel 132 and causes the engine to begin operation.

In the illustrated arrangement, the housing 200 is connected to the crankcase 76 in a manner which will be described below. In particular, with reference to FIG. 13, the first member 202 of the housing is connected to the cylinder block 70. The second member 204 of the housing 200 is connected to the cylinder block 70 through the first member 202 in the illustrated arrangement. Of course, in some arrangements, the first member can be connected to the cylinder block while the second member is connected to the first member.

Preferably, a sealing gasket 214 is interposed between the first member 202 and the second member 204. The sealing gasket maintains a watertight seal between the two members 202, 204.

In the illustrated arrangement, the starter motor 134 and in particular the main body of the starter 206 is connected to the first member 202 through the use of threaded fasteners 216. Preferably, the threaded fasteners 216 extend through a set of mounting flanges 218. The mounting flanges are formed on the starter motor 134 in the illustrated arrangement. The threaded fasteners 216 also extend through a portion of the first member 202 such that the first portion 202 and the starter motor 134 are joined together. Moreover, the threaded fasteners 216 extend through a sealing gasket 220 that is interposed between the cylinder block 70 and the first member 202. Thus, the threaded fasteners 216 are used to connect the starter motor and the first member 134, 202, as well as the gasket 220, to the cylinder block 70. In some constructions, the starter motor 134 can be connected to the first member 202 while the first member 202 is connected to the crankcase 70 at different locations. Furthermore, in other configurations, the starter motor 134 can be connected to the second member 204.

In the illustrated arrangement, the outer second member 204 of the housing 200 includes a set of mounting apertures 222. The mounting apertures 222 preferably are formed around a mounting flange 224. In addition, the apertures 222 accommodate a set of threaded fasteners 226 that can be used to attach the second member 204 to the first member 202 and, in some cases, to the cylinder block 70. In such configurations, the first member 202 includes a throughhole 228. The throughhole 228 preferably accommodates the threaded fastener 226 and allows the threaded fastener 226 to extend through the first member 202 and into the cylinder block 70.

Figure 12:
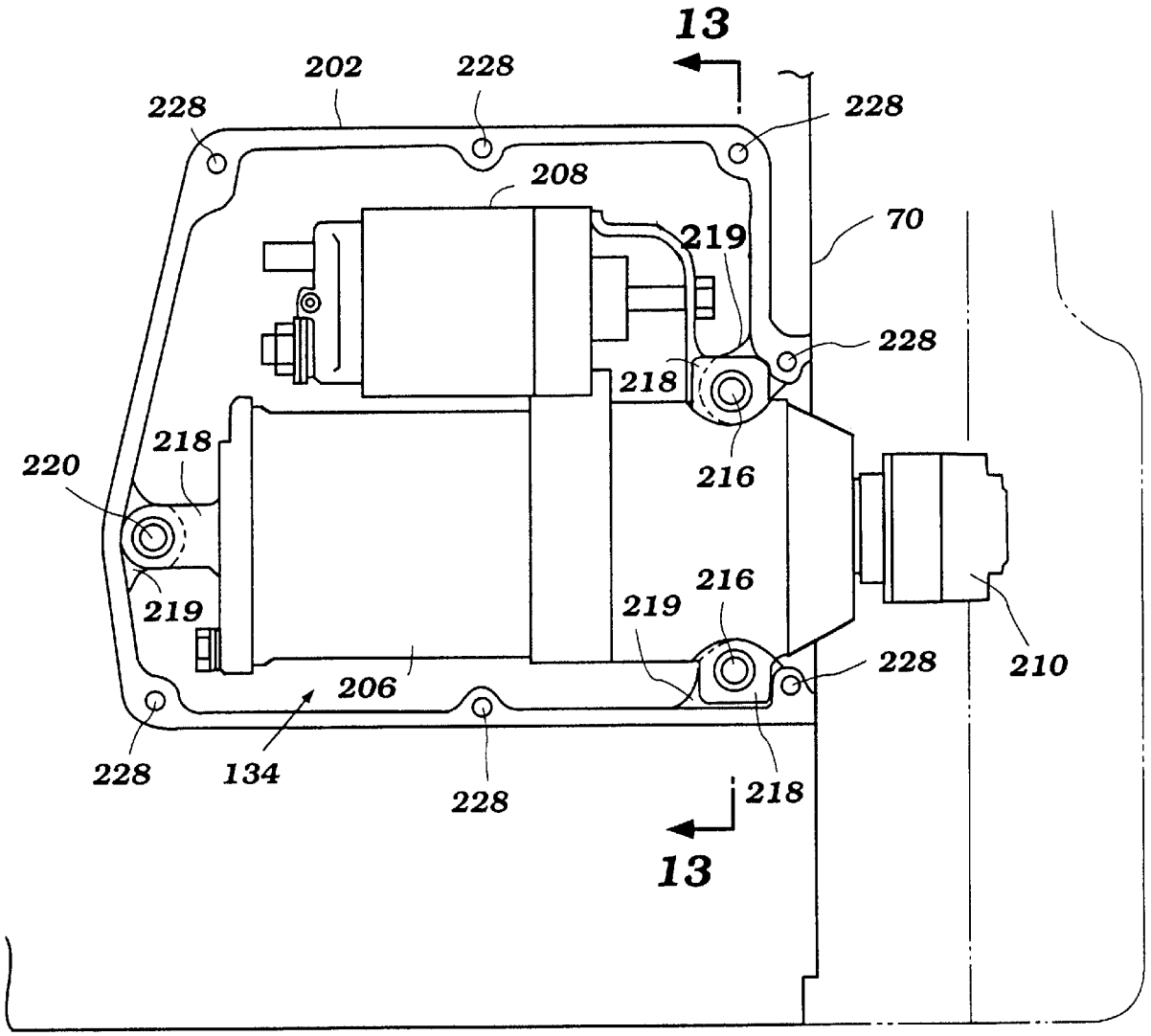
FIG. 12 is a side elevation view of the starter motor compartment with the cover removed.
Figure 13:
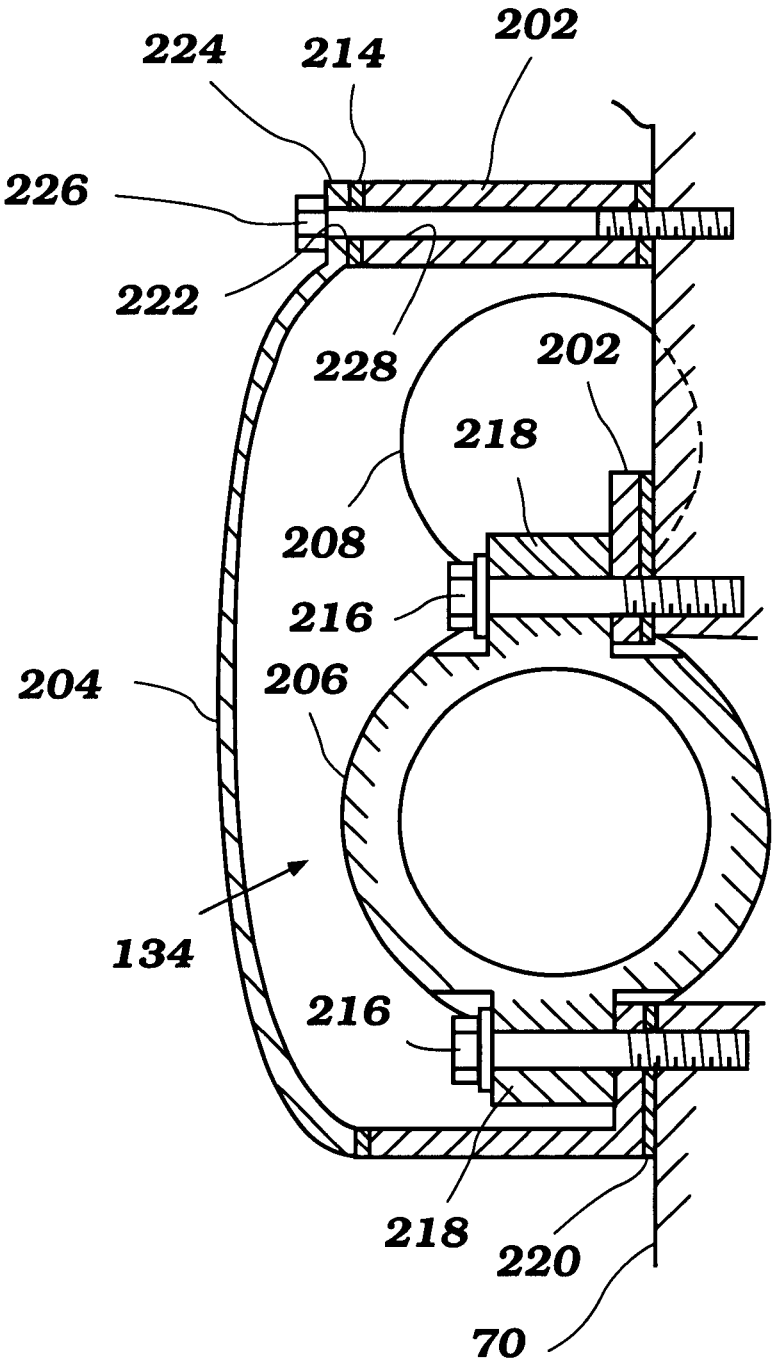
FIG. 13 is a section view of the starter chamber with the covers attached.

With continued reference to FIG. 12, the illustrated first member 202 of the housing 200 includes a set of mounting bosses 219. The mounting bosses 219 are coordinated with the mounting lug extensions 218 formed on the starter motor unit 134. In this manner, the bolt 220 can pass through the bosses 219 and the lugs 218 to secure the starter motor 134 to the housing 200.

Figure 11:
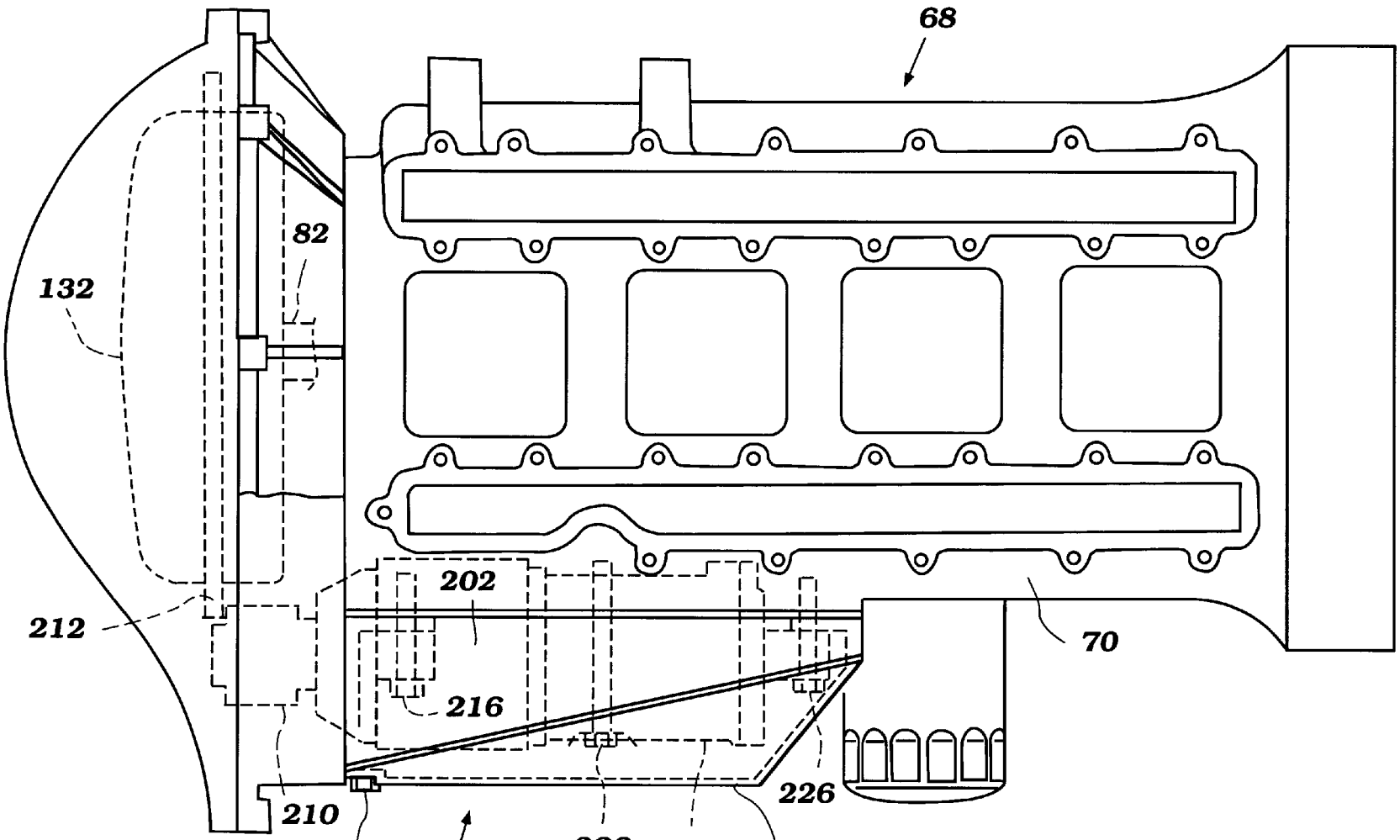
FIG. 11 is a top plan view of the engine of FIG. 3 illustrating a placement of the starter motor relative to the cam drive arrangement.

With reference now to FIG. 11, it can be seen that the housing 200 is formed with a tapering sidewall to better accommodate the components within the housing. In the illustrated arrangement, a portion of the sidewall inclines towards the cylinder block 70 to reduce the size of the enclosure while comfortably accommodating the components inside the housing 200. Thus, the enclosure protects the starter motor 134, including the associated components, from exposure to water that might intrude into the engine compartment of the watercraft 20. In addition, the arrangement provides easy access as well as a stable mounting arrangement by having an outer second cover member that is detachably connected to the inner first cover member. By passing a single threaded fastener through both members, the housing can be securely mounted for use while providing ease of access in an arrangement in which at least a portion of the housing remains affixed to the cylinder block, when those fasteners are removed, such as during maintenance.

Of course, the foregoing description is that of certain features, aspects and advantages of the present invention to which various changes and modifications may be made without departing from the spirit and scope of the present invention. For instance, various features of one ventilation arrangement can be easily modified for use with any of the other ventilation arrangements. Accordingly, swapping of various vent ducts between arrangements is fully contemplated. Moreover, a watercraft need not feature all objects of the present invention to use certain features, aspects and advantages of the present invention. The present invention, therefore, should only be defined by the appended claims.

What is claimed is:

1. An engine for a personal watercraft, said engine comprising an engine body comprising a crankcase member, a cylinder block and a cylinder head, at least one cam shaft extending outside of said engine body, a driven pulley attached to said at least one cam shaft and being positioned outside of said engine body, a crankshaft also extending outside of said engine body, a drive pulley connected to said crankshaft and being positioned outside of said engine body, a flexible transmitter looped around said driven pulley and said drive pulley, a chamber being defined by at least a portion of said engine body and a first cover member, a cooling jacket extending through at least a portion of said first cover member.

2. The engine of claim 1, wherein the first cover member comprises a circumferential side wall, the side wall having a portion that extends generally parallel to a portion of a travel path of said flexible transmitter, and said cooling jacket extending through said side wall.

3. The engine of claim 2, wherein said cooling jacket extends through said portion that extends generally parallel to said portion of said travel path of said flexible transmitter.

4. The engine of claim 1 further comprising a second cover member that is interposed between said first cover member and said engine body.

5. The engine of claim 4, wherein said cooling jacket extends across a portion of a travel path of said flexible transmitter.

6. The engine of claim 4 further comprising an idler pulley contacting said flexible transmitter and said cooling jacket extending over at least a portion of said idler pulley.

7. The engine of claim 6, wherein said cooling jacket extends about a periphery of said first cover member.

8. The engine of claim 7, wherein said cooling jacket extends over said driven pulley.

9. The engine of claim 6, wherein said cooling jacket extends over a central portion of said first cover member.

10. The engine of claim 9, wherein said cooling jacket extends over said driven pulley.

11. The engine of claim 5, wherein said cooling jacket extends over at least a portion of said drive pulley.

12. The engine of claim 5 further comprising an air inlet duct, wherein said cooling jacket extends into an opening defined by said air inlet duct.

13. The engine of claim 12, wherein said cooling jacket extends over at least a portion of said driven pulley.

14. The engine of claim 4, wherein said engine body comprises a first sealing surface positioned on at least one of said cylinder block and said crankcase member and a second sealing surface positioned on at least one of said cylinder block and said cylinder head, a first opening being defined through said second cover member and said engine body, said crankshaft extending through said first opening, a second opening being defined through said second cover member and said engine body, said at least one cam shaft extending through said second opening, a third sealing surface being formed on said second cover member, said third sealing surface extending at least partially around said first opening and abutting at least a portion of said first sealing surface, a fourth sealing surface being formed on said second cover member, said fourth sealing surface extending at least partially around said second opening and abutting at least a portion of said second sealing surface, said first cover member abutting said second cover member and enclosing at least one of said first opening and said second opening.

15. The engine of claim 14, wherein said first cover member encloses both said first opening and said second opening.

16. The engine of claim 1 further comprising a starter motor positioned within a substantially sealed starter motor compartment, said starter motor compartment comprising a first member and a second member, said starter motor being connected to said first member and to said engine body and said second member being connected to said first member and to said engine body separate of said starter motor.

17. The engine of claim 1 further comprising a cooling jacket that extends over at least a portion of said starter motor compartment.

18. The engine of claim 17 further comprising a sealing gasket being interposed between said first member and said second member.

19. An engine for a personal watercraft, said engine comprising an engine body comprising a crankcase member, a cylinder block and a cylinder head, at least one cam shaft, a driven pulley attached to said at least one cam shaft, a drive pulley connected to said crankshaft, a flexible transmitter looped around said driven pulley and said drive pulley, a chamber being defined by at least a portion of said engine body, a first cover member and a second cover member, said engine body comprising a first sealing surface positioned on at least one of said cylinder block and said crankcase member and a second sealing surface positioned on at least one of said cylinder block and said cylinder head, a first opening being defined through said second cover member and said engine body, said crankshaft extending through said first opening, a second opening being defined through said second cover member and said engine body, said at least one cam shaft extending through said second opening, a third sealing surface being formed on said second cover member, said third sealing surface extending at least partially around said first opening and abutting at least a portion of said first sealing surface, a fourth sealing surface being formed on said second cover member, said fourth sealing surface extending at least partially around said second opening and abutting at least a portion of said second sealing surface, said first cover member abutting said second cover member and enclosing at least one of said first opening and said second opening.

20. The engine of claim 19 further comprising a first water jacket extending through at least one of said first cover member and said second cover member.

21. The engine of claim 20, wherein said first water jacket extends through said first cover member and a second water jacket extends through said second cover member.

22. The engine of claim 20, wherein said first water jacket extends about a periphery of said first cover member.

23. The engine of claim 19 further comprising a starter motor disposed within a substantially sealed starter motor compartment.

24. An engine for a personal watercraft, said engine comprising at least one drive pulley, at least one driven pulley, a flexible transmitter coupling said drive pulley and said driven pulley, said drive pulley, said driven pulley and said flexible transmitter being positioned within a belt chamber, said engine further comprising means for cooling said belt chamber.

25. The engine of claim 24 further comprising an engine body comprising a crankcase, a cylinder block and a cylinder head, said belt chamber being at least partially defined by a first cover member and said engine body.

26. The engine of claim 25 further comprising a second cover member interposed between said first cover member and said engine body.

27. The engine of claim 26 further comprising a starter motor positioned within a substantially sealed starter motor compartment and said means for cooling said belt chamber further cooling at least a portion of said starter motor compartment.

28. The engine of claim 26, wherein a first seal is defined between said first cover member and said second cover member and a second seal is defined between said second cover member and said engine body.

29. The engine of claim 28, wherein said second seal comprises a first portion and a second portion, said first portion being disposed proximate said drive pulley and said second portion being disposed proximate said driven pulley.

* * * * *